US005254183A

United States Patent [19]

Harris, III et al.

[11] Patent Number: 5,254,183

[45] Date of Patent: Oct. 19, 1993

[54] GAS TURBINE ELEMENTS WITH COKE RESISTANT SURFACES

[75] Inventors: John A. Harris, III, West Palm Beach; William H. Edwards, III, Port St. Lucie; Edward S. Smith, Lake Worth, all of Fla.

[73] Assignee: United Techynologies Corporation, Hartford, Conn.

[21] Appl. No.: 811,346

[22] Filed: Dec. 20, 1991

[51] Int. Cl.[5] ..... C22F 1/00

[52] U.S. Cl. ..... 148/318; 148/218; 148/237; 148/238

[58] Field of Search ..... 148/318, 218, 238, 237

[56] References Cited

U.S. PATENT DOCUMENTS

| | | | |
|---|---|---|---|
| 1,065,379 | 6/1913 | Machlet | 148/218 |
| 2,804,410 | 8/1957 | Wyatt et al. | 148/237 |
| 3,870,572 | 3/1975 | Brugger et al. | 148/318 |
| 4,264,380 | 4/1981 | Rose et al. | 148/318 |
| 4,495,003 | 1/1985 | Kubo | 148/318 |
| 4,511,411 | 4/1985 | Brunner et al. | 148/237 |
| 4,588,450 | 5/1986 | Purohit | 148/238 |
| 4,904,316 | 2/1990 | Dawes et al. | 148/318 |
| 5,039,357 | 8/1991 | Epler et al. | 148/218 |

FOREIGN PATENT DOCUMENTS

| | | | |
|---|---|---|---|
| 2415553 | 10/1975 | Fed. Rep. of Germany | 148/237 |
| 281424 | 8/1990 | German Democratic Rep. | 148/218 |
| 2-08476 | 10/1985 | Japan . | |
| 0060269 | 3/1988 | Japan | 148/237 |
| 1006540 | 3/1983 | U.S.S.R. . | |
| 1088879 | 4/1984 | U.S.S.R. . | |

*Primary Examiner*—Upendra Roy
*Attorney, Agent, or Firm*—Herbert W. Mylius

[57] ABSTRACT

Elements for use as protecting fuel contacting surfaces of a gas turbine engine are protected from carbon deposition by heating the element in a nitrogen containing atmosphere for sufficient time to cause penetration and absorption of nitrogen into the grain boundaries of the alloy surface, which acts as a barrier between the hydrocarbon fuel and the catalytic elements in the surfaces.

12 Claims, No Drawings

GAS TURBINE ELEMENTS WITH COKE RESISTANT SURFACES

The invention was made under a U.S. Government contract and the Government has rights herein.

BACKGROUND OF THE INVENTION

1. Field of the Invention

This invention relates to a treatment for preventing the deposition of carbon, or coke, on fuel wetted surfaces located in high temperature zones of gas turbine engines. Coke deposition is an undesirable side effect caused by the catalytic-thermal degradation of hydrocarbon fuels during their consumption in gas turbine engines. Such deposition leads to performance loss, reduced heat transfer efficiencies, increased pressure drops, costly decoking procedures, and increased rates of material corrosion and erosion. The metals most prone to catalyze coke deposition are those metals commonly found in the alloys utilized in components exposed to high temperature, fuel wetted environments of gas turbine engines, typically found in jet engines in the combustor and afterburner fuel delivery systems.

2. Description of the Prior Art

Carburization, or the formation of coke deposits, has been noted particularly in high temperature environments where carbon containing fluids come in contact with metals or metal alloys. Exemplary of such environments are high temperature reactors, such as refinery crackers, thermal crackers, distillation units for petroleum feedstock, and gas turbine components. Conventional methods used to reduce coke formation and carburization in steam cracking operations involve the steam pretreatment of the surface to promote formation of a protective oxide skin. The surface may then be further protected by the deposition of a high temperature, stable, non-volatile metal oxide on the pre-oxidized substrate surface by thermal decomposition from the vapor phase of a volatile compound of the metal.

While the chemical vapor deposition of an alkoxysilane has been demonstrated to reduce the rate of coke formation in the pyrolysis section of an ethylene steam cracker by formation of an amorphous silica film on the internal surfaces of high alloy steel tubing at 700° to 800° C., no one to date has solved the problem of coke deposition on fuel contacting hardware in gas turbine engines.

SUMMARY OF THE INVENTION

The present invention relates to treated elements for use as fuel contacting components of gas turbines, such as in the combustor and afterburner of a jet engine. A thermally resistant barrier on such elements prevents contact of the fuel with catalytic agents such as iron, nickel, and chromium, contained in the base metals from which fuel contacting components are fashioned. Specifically, the fuel contacting components are subjected to heat treatment in a nitrogen atmosphere, so as to form a surface nitrogen layer which deactivates the surface sites to which carbon would normally attach.

DESCRIPTION OF THE PREFERRED EMBODIMENTS

Coke deposition has been found to be an undesirable side effect caused by the thermally accelerated degradation of hydrocarbon fuels during their use for power generation in gas turbine engines. It is a particular goal of the present invention to reduce the deposition of carbon on fuel contacting components of gas turbine engines such as fuel nozzles, fuel lines, and augmentor spray manifolds, and such other areas as lubrication systems and breather tubes.

It is known that hydrocarbon fuels may degrade either under high temperature conditions, i.e. thermally, or under lower temperature conditions in the presence of a catalytic material. One approach to the problem in the past has been to regulate the quality of the fuel consumed, so as to limit degradation thereof. However, as engines are required to run faster and hotter to achieve greater output, the ability of present day hydrocarbon fuels to provide the required performance without coking is lessened. Further, since many of the metals required for the construction of higher temperature gas turbine engines are catalytic to the degradation of hydrocarbon fuels, coke formation has become of greater concern. Accordingly, a method has been sought to increase the temperature at which engines may operate without degradation of the fuel and deposition of coke. It has now been found that this may be achieved by nitriding the surface of the fuel contacting elements. This may be accomplished by subjecting the surface to a specific heat treatment procedure, in the presence of an atmosphere selected from nitrogen, mixtures of hydrogen and nitrogen, and ammonia. The penetration and absorption of nitrogen into the grain boundaries of the alloy surface acts as a barrier between the hydrocarbon and the catalytic elements in the surfaces. While the process utilized in preparing the elements of the present invention may not be truly a "nitriding" process as the term is conventionally used, it is to be understood that term as used herein is meant to connote a process wherein a metal alloy surface is subjected to a heat treatment procedure in the presence of an atmosphere containing nitrogen or a source thereof. It has been found that metals subjected to such treatment either do not participate in the mechanism of catalytic-thermal deposition of coke, or participate to a much lesser degree than such metals as iron, nickel, chromium, or their alloys. It has also been noted in the course of our investigations that such treatments actually enhance the degradation of carbon containing fuels. These nitrided surfaces, when exposed to elevated temperatures, enable any gums and/or vanishes which do form to completely burn away. Appropriate cleaning steps, pretreatments, and post-treatments as are known in the art may be utilized. Actual cleaning procedures, heat treatment temperatures, and the composition of the gaseous nitrogen source may be dependent upon the composition of the substrate, and the difficulty of application to all fuel contacting surfaces of the element being protected. The actual depth of the resulting surface absorbed nitrogen may be from about 0.00001 inches to about 0.0005 inches, preferably less than about 0.0001 inches. Such a surface is mechanically stable, resistant to hydrocarbon fuels, and is thermally stable at temperatures up to at least the temperature limits of the substrate alloy. The actual heat treatment and nitriding step may be performed in a conventional retort, using a nitrogen source atmosphere, such as pure nitrogen, a mixture of nitrogen and up to about 2.0 weight percent hydrogen, wherein the presence of hydrogen ties up trace oxygen, or high purity ammonia. The heat treatment should be conducted at temperatures suitable for the specific alloy substrate, and for sufficient time to achieve effective nitriding of the surface. While times and temperature may be varied, the following procedure is preferred for Waspaloy materials. The piece may be solution heat treated at 1825° F., in the atmosphere chosen, with a one hour hold at temperature. After cooling at a rate of not less than 40° F. per minute to 1550° F., stabilization heat treat may be conducted by holding at temperature for four hours. After cooling at a rate of not less than 40° F. per minute to 1400°, the piece may be precipitation heat treated at temperature for approximately sixteen hours, followed by cooling to room temperature at any convenient rate. All steps are to be under the chosen nitrogen containing atmosphere, at temperatures plus-or-minus 25 degrees of the indicated temperatures. While this procedure is preferred, it is also contemplated that nitriding may be accomplished on previously heat treated materials, by holding them at an appropriate temperature, such as from about 1400° F. to about 1600° F., for an appropriate time period, such as from about three hours to about six hours, under a positive nitrogen atmosphere pressure.

A number of primary factors were identified which relate to the deposition of hydrocarbons in gas turbines. These include fuel composition, temperature, time, the availability of oxygen, and the presence of catalytic materials in the surface of the fuel handling components. For an operating gas turbine, each of these factors has an almost infinite number of possible values, with the exception of the composition of the fuel contacting elements of the gas turbine engine itself. Accordingly, the present invention is directed to control of the surface composition of the fuel handling components of the gas turbine engine, and specifically to the provision of a nitrided surface thereupon to reduce the deposition of carbon, or coking.

Alloys used in hydrocarbon fuel burning engines commonly contain metals which catalyze coke deposition, such as iron, nickel, and chromium. Thermal degradation occurs as a matter of course, and there are periods during the operation of turbine engines when fuel flow is very low, or as in the case of military engine augmentor plumbing, i.e. fuel feed tubes and spray manifolds, there is no fuel flow at all. During such periods, the temperature of the residual fuel left in the plumbing can rise, causing increased coke deposition from accelerated feul degradation reactions and thermal cracking. The contributions of various metallic hardware surfaces to coke deposition were evaluated with a goal of determining the best method for reducing the formation and adherence of coke. It has been learned that coking may be reduced by application of a surface layer of an anti-coking material to the surfaces of the fuel handling components of a gas turbine engine. Such anti-coking materials may be of a nature to either reduce or inhibit the tendency of coke to adhere to the surface, or, conversely, to enhance the catalysis of the surface and increase the reactivity such that any gums and varnishes which tend to form are caused to react further, breaking them down to gaseous products which are eliminated.

Surfaces which may be nitrided for prevention of coking include fuel lines, fuel nozzles, augmentor spray manifolds and other hydrocarbon contacting surfaces of gas turbines, such as lubrication systems and breather tubes. Such surfaces may comprise such materials as titanium and titanium alloys, aluminum, stainless steels, and nickel base alloys such as Inconel and Waspaloy. In addition, the present invention may be suitable for prevention of coking on other surfaces, such as copper, zirconium, tantalum, chromium, cobalt, and iron, for example. While the examples which follow relate to nitriding components fashioned of Waspaloy or Inconel alloys, it is to be understood that the present invention is not to be limited thereto.

To evaluate the effectiveness of experimental treatments in reducing the tendency of jet fuel to form coke deposits on a metal substrate, Waspaloy samples were utilized under conditions simulating the operational conditions to be anticipated in a high performance military aircraft engine. In a typical military flight scenario, fuel is heated as it travels through the fuel plumbing on its way to the combustor and/or augmentor of the engine to be burned. Generally, the fuel flow rate is sufficiently high to limit the effect of those factors which relate to coking. However, during flight, when the augmentor is shut off, spray manifold temperatures in the afterburner section rise considerably, going from about 350° F. to about 1000° F. or higher in some areas. Residual fuel left in the spray manifolds in these areas boils and degrades rapidly to form insoluble, sticky, gum-like varnishes, which after a number of cycles results in formation of coke deposits. A similar scenario occurs in the engine combustor fuel nozzles at engine shutdown. However, since the augmentor is cycled on and off much more frequently than the engine is, it is to be expected that the augmentor fuel plumbing would have a higher coking rate than the combustor fuel nozzles. Accordingly, the conditions encountered at the spray manifold of the augmentor section were selected as representative of conditions which result in coke deposition.

It was theorized that coke deposition tends to begin at reactive sites along the metallic alloy crystal plane edges. It is believed that it is at these sites that coke deposits first attach, and then begin to build up, with alloying elements of the metallic surface migrating into the coke deposit as it builds up. This occurrence could then cause secondary deposition and growth away from the metal surface. This in effect thickens the deposit, and would cause reduced heat transfer, pressure drops, flow reductions, etc. It has now been found that chemically treating the metallic active sites to neutralize them, i.e. nitriding them, greatly reduces the metal/carbon reaction mechanism, and reduces both liquid and vapor phase coking rates.

The contribution to the process of coke formation in the augmentor manifolds of military aircraft engines by the catalytic action of the alloying elements in the Waspaloy material used therein is not precisely known, even though there are known examples of other types of hydrocarbon/metallic surface coking phenomena. In every known case where coatings showed reductions in coking rates, the temperature regimes were much higher, i.e. above about 1500° F., and conducted in continuously flowing steam carrier environments, such as used in ethylene steam cracking operations. In addition, the hydrocarbon types being processed were very different from current jet fuels, i.e. olefin rich. While catalytically inert coatings, such as silica, apparently work for such applications, those are continuously flowing systems, as opposed to augmentor manifold sections.

EXAMPLE 1

Considering the above, it was thought that it might prove useful to test various approaches to determine their ability to promote the gasification of coke deposits under conditions similar to those thought to exist in an operating engine between augmentation cycles, i.e. after shutdown of the afterburners. If a treatment could be found which did not permit a greater coke deposition rate than did the Waspaloy, then the initial deposits which did form might be removed during higher temperature periods when the augmentor was shut down. If the removal rate were great enough, then deposits would be removed almost as they formed.

Coatings of silica, alumina, and tungsten disulfide were initially evaluated, as well as nitride treatment of Waspaloy surfaces, for effectiveness. Silica coatings were applied by dipping in a solution containing 41.3 tetramethylortho-silicate (TMOS), 38.9% methanol, and 19.8% distilled water. The specimen surface was first preoxidized at 1000° F. The dip was followed by air drying, and repeated four times, followed by firing at 1000° F. Sol gel alumina coatings were applied in a manner similar to the TMOS silica, but in two sets of four dips each with frings at 1112° F. in vacuum ($10^{-5}$ torr) for 5 hours between dip sets. The tungsten disulfide coatings were applied through an air blast gun at 120 psi, with the gun positioned 10 to 12 inches from the surface. Surface nitriding was done by heating the sample in a retort, under a nitrogen atmosphere, at 1825° F. for one hour, at 1550° F. for four hours, and at 1400° F. for sixteen hours, followed by cooling under nitrogen to below 500° F. before removal from the retort. These samples were than subjected to coking to establish a layer of coke on the surfaces thereof by heating in jet fuel.

To test coke gasification from these samples, a furnace was set up with a nitrogen purge to reduce the air content to approximate that existing in the spray manifold area after augmentor cancellation. Blank and coated or nitrided Waspaloy samples which had been previously coked were placed in the furnace and heated to 1050° F. for two hours. Weight changes were recorded, but apparently substrate oxidation weight gains offset some weight loss from coke gasification, as apparent from examination of the samples under magnification. The untreated (blank) samples had lost some, but very little, deposit. The treated tubes ranked as set forth in TABLE I with respect to the reduction of coke deposit.

TABLE I

COKE DEPOSIT LOSS

| Coating/treatment | Reduction |
|---|---|
| Nitrided Waspaloy | 30% |
| Tungsten Disulfide | 30% |
| Sol gel alumina | 90% |
| TMOS silica | 100% |

These results are indicative that even if small coke deposits occur during augmentation cycling, those deposits may be gasified during the "off" cycle of the augmentor, if the augmentor surface is protected.

EXAMPLE 2

Based upon the above results, special liquid/vapor phase reactors were constructed to enable evaluation of several alloy types and candidate treatments for their fuel deposit buildup tendencies. The reactors were designed so that the coking variables, i.e. temperature, time, fuel composition, oxygen availability, and plumbing material, could be controlled and varied to simulate conditions as desired.

The reactor comprised a Pyrex glass test tube closely fitted within a stainless steel tube with Swagelok® stainless steel end caps. A two way valve permitted introduction of desired atmospheres and pressure, through a drilled and back welded twelve inch length of stainless steel tubing. The top reactor fitting permitted disassembly of the reactor for cleaning and loading of new test materials. A two way valve was used to control flow of fuel and atmosphere. The Pyrex glass tube was utilized to minimize contact of the fuel and its vapor with the metallic reactor walls, ensuring that results were representative of coking on the test washers only. The test washers were hung in the vapor space of the reactor from a type 316 stainless steel tube, bent to suspend and keep separated a blank or untreated Waspaloy washer and the washer being tested. In this way, any slight variations during the coking test would be negated, since both the control and test washers would be affected equally. Test temperatures were controlled by placing the reactors in a heated aluminum block, controlled at plus or minus 2° F. of the desired temperature. Test washers were ¾ inch diameter, with a ¼ inch hole in the center. Test washers were treated as set forth below, and were tested against untreated, or "blank" washers to determine effectiveness of the treatments applied.

Coatings of tungsten disulfide were applied to test washers using an air blast gun, at 120 psi, with the gun located 10 to 12 inches from the test parts, resulting in a monolayer thickness of from about 0.000015 to about 0.000020 inches.

Test washers were coated with mixed alumina-silica sol gels by a procedure comprising dipping the washer in the sol and air drying, for four applications of sol. Two sets of dipping and drying were performed, with a five hour firing at 1112° F. conducted between the sets. Two different sol gels were applied to independent test washers for evaluation. The first sol gel, designated AP5, comprised 60.5 parts methyl alcohol, 30.3 parts silica sol, and 9.1 parts aluminum sec-butoxide sol. The second sol, designated AP7, comprised 78.3 parts methyl alcohol, 4.4 parts silica sol, and 17.3 parts aluminum sec-butoxide sol.

Test washers were subjected to surface nitriding by heating in a retort, under a nitrogen atmosphere, at 1825° F. for one hour, at 1550° F. for four hours, and at 1400° F. for sixteen hours, followed by cooling under nitrogen to below 500° F. before removal from the retort.

The amount of fuel chosen for use in the tests and the size of the reactors were based upon the estimated residual fuel left in an augmentor spray manifold of a military aircraft engine augmentor after shutdown, and the spray manifold total internal volume. The Number 3 spray manifold was chosen since it was known to have the most severe coking problem for the specific engine being simulated. The residual fuel volume to vapor space volume was estimated to be 1:7.5. Accordingly, the fuel volume used in these tests was 10 ml, and the reactor vapor space volume was about 75 ml, to simulate actual engine conditions.

In order to approximate the cycling of an augmentor, the time at temperature for the reactors was cycled. Three 1.5 hour cycles were used. At the end of each cycle, the reactors were weighed, rapidly cooled in water, depressurized, repressurized with 30 psig air, and replaced in the heated block. After the third cycle, the reactors were opened and the test washers were dried at 230° F. for 15 minutes. The washers were then weighed to determine the percentage increase or decrease relative to the blank Waspaloy washer.

The test were conducted at 550° F., and air pressure of 30 psig. Air pressures above this caused auto-ignition of the fuel, evidenced by copious sooting within the reactors, at 550° F. and above. Pressures below this value produced incrementally lower deposit weights, so to obtain measurable deposit weights within a reasonable time, the 30 psig pressure was selected. The test fuel used was JP-4, taken from a single two gallon sample stored at room temperature.

In addition to measuring coke deposition on the test washers, a second test was conducted to determine whether the treatment applied to the washer possessed the ability to reduce the temperature of carbon burnoff relative to Waspaloy. For this test, the burnoff temperature and the amount of deposited carbon were determined by use of a LECO Model RC412 Multiphase Carbon Determinator. An air combustion atmosphere was used rather than oxygen, to simulate actual flying conditions. Test results are as set forth in TABLE II, below. Since the LECO carbon analysis confirmed the gravimetric results, only the Leco carbon result is given for percent change in coking.

TABLE II

CARBON DEPOSITION AND BURNOFF

| Surface | Change | Burnoff Temp. |
|---|---|---|
| Waspaloy, uncoated | — | 930° F. |
| Waspaloy, nitrided | −57% | 820° F. |
| Tungsten disulfide | +25% | 918° F. |
| AP5 Alumina-silica | −14% | 925° F. |
| AP7 Alumina-silica | −19% | 940° F. |

These results indicate that protective surface treatments may be applied to fuel contacting elements to either inhibit carbon deposition and coking, or to enhance the burnoff of such coke as is deposited.

EXAMPLE 3

An augmentor spray manifold was surface nitrided by heat treatment in a nitrogen/hydrogen atmosphere at 1500° F. for five hours. This manifold was then tested in an operating jet engine, utilizing JP-8 jet fuel. After 1800 Accelerated Mission Test Tactical Air Cycles, the time duration of each cycle being approximately 45 minutes, the spray manifold demonstrated a 12 percent decrease in the rate of coke build up, as compared to two similar manifolds which were not nitrided. However, Waspaloy test washers were surface nitrided along with the spray manifold. Surface elemental analysis of these washers found nitrogen content to be 15 percent, oxygen 22 percent, and carbon 28 percent. Accordingly, contamination of the heat treat atmosphere with oxygen and the Waspaloy test specimens with a carbon source appeared to have occurred. Further, the maximum temperature of the treatment was only 1500° F., while it is believed that greater coke deposition rate reductions are obtained when the heat treatment is at a higher temperature. For instance, a 50 percent reduction in coking rate, relative to polished Waspaloy, was obtained for a Waspaloy washer heat treated in nitrogen for six hours at 1600° F. However, a similar Waspaloy test washer heat treated in nitrogen-2 percent hydrogen at 1500° F. for five hours produced a 39 percent reduction in coking rate, relative to polished Waspaloy.

EXAMPLE 4

Four test washers were heat treated in differing atmospheres at 1825° F. for one hour, then at 1550° F. for four hours, and finally at 1400° F. for sixteen hours. The atmospheres used were argon (Ar), nitrogen ($N_2$), nitrogen/hydrogen ($N_2H_2$), and air. All gases used were of high purity from bottled gas sources, and positive pressure was maintained on the furnace retort throughout each heat treatment cycle.

One representative washer from each atmosphere heat treatment, and one untreated polished Waspaloy washer, were run in a pressurized vapor phase coker to cause the deposition of carbon on their surfaces. The coked washers were first gravimetrically measured, and then analyzed in a Leco RC412 Total Carbon Analyzer to verify carbon amounts for each test specimen. Table III summarizes the results of the coking tests. Both the gravimetric and carbon analyzer results are given, and the average of the two was used to calculate the percent decrease in the coking rate. All results shown are the averages of at least duplicate tests, with coefficients of variation of less than 10 percent.

TABLE III

HEAT TREAT ATMOSPHERE

| | None | Ar | $N_2$ | $N_2H_2$ | Air |
|---|---|---|---|---|---|
| Gravimetric (mg) | 0.97 | 0.47 | 0.35 | 0.41 | 0.69 |
| Leco RC412 (mg) | 0.82 | 0.39 | 0.30 | 0.32 | 0.56 |
| Average % Change* | — | 52.2 | 63.9 | 59.4 | 30.6 |
| Average % Change** | — | — | 24.4 | 15.1 | (45.3) |

*Decrease compared to polished Waspaloy
**Decrease compared to argon treatment
( ) Increase compared to argon treatment The somewhat higher values obtained by the gravimetric analysis probably reflect moisture absorption by the coke deposit, as well as sulfur, oxygen and other trace elements which are commonly found in coke deposits. The Leco carbon analyzer is carbon specific, however, and only detects the carbon present in the coke deposit. Relative to the polished Waspaloy, all four atmospheres produced reductions in coking rates. However, the nitrogen and nitrogen/hydrogen atmospheres demonstrated reductions in carbon deposition as compared to the argon atmosphere.

It may be concluded that heat treatments as indicated do have a beneficial effect upon the deposition rate of coke on Waspaloy alloy components of a gas turbine engine in contact with hydrocarbon fuel. It was specifically found that heat treatment in nitrogen produced the greatest coke deposition rate reductions. Further, the surface of the Waspaloy alloy is chemically altered, with a noted reduction in nickel and other alloying element content, although true nitriding did not appear to have been accomplished.

It is to be understood that the above description of the present invention is subject to considerable modification, change, and adaptation by those skilled in the art to which it pertains, and that such modifications, changes, and adaptations are to be considered within the scope of the present invention, which is set forth by the appended claims.

What is claimed is:

1. A fuel contacting element for a gas turbine engine, said element comprising a material selected from the group consisting of titanium, titanium alloys, stainless steel, and nickel base superalloys, and having a surface absorbed nitrogen layer having a depth of from about 0.00001 inches to about 0.0005 inches formed by heating said element in an atmosphere selected from nitrogen, mixtures of hydrogen and nitrogen, and ammonia, at a temperature of from about 1800° to about 1850° F. for about one hour, cooling to a temperature of from about 1525° to about 1575° F. and holding for about four hours, and cooling to a temperature of from about 1375° to about 1425° F. and holding for about sixteen hours.

2. An element as set forth in claim 1, wherein said depth is less than about 0.0001 inches.

3. An element as set forth in claim 2, wherein said material is a nickel base superalloy.

4. An element as set forth in claim 3, wherein said atmosphere is nitrogen.

5. A spray manifold for the augmentor section of a jet engine, said manifold comprising a metal alloy selected from the group consisting of titanium, titanium alloys, stainless steel, and nickel base superalloys, said alloy having a coke inhibiting layer of surface absorbed nitrogen thereupon to a depth of from about 0.00001 inches to about 0.0005 inches, said layer resulting from nitriding said alloy in an atmosphere selected from the group consisting of nitrogen, mixtures of hydrogen and nitrogen, and ammonia at a temperature of from about 1800° to about 1850° F. for about one hour, cooling to a temperature of from about 1525° to about 1575° F. and holding for about four hours, and cooling to a temperature of from about 1375° to about 1425° F. and holding for about sixteen hours.

6. A manifold as set forth in claim 5, wherein said depth is less than about 0.0001 inches.

7. A manifold as set forth in claim 6, wherein said material is a nickel base superalloy.

8. A manifold as set forth in claim 7, wherein said atmosphere is nitrogen.

9. A coke resistant metal alloy having a high nitrogen content surface layer to a depth of from about 0.00001 inches to about 0.0005 inches as a result of heat treatment in an atmosphere selected from the group consisting of nitrogen, mixtures of hydrogen and nitrogen, and ammonia, at a temperature of from about 1800° to about 1850° F. for about one hour, cooling to a temperature of from about 1525° to about 1575° F. and holding for about four hours, and cooling to a temperature of from about 1375° to about 1425° F. and holding for about sixteen hours.

10. An alloy as set forth in claim 9, wherein said alloy is selected from the group consisting of titanium, titanium alloys, stainless steel, and nickel base superalloys.

11. An alloy as set forth in claim 10, wherein said depth is less than about 0.0001 inches.

12. An alloy as set forth in claim 11, wherein said atmosphere is nitrogen.

* * * * *